US005373484A

United States Patent [19]

Rappo et al.

[11] Patent Number: 5,373,484

[45] Date of Patent: Dec. 13, 1994

[54] WATCH CASE WITH SEPARABLE BACK COVER

[75] Inventors: Jean-Louis Rappo; Bernard Gigandet, both of Bassecourt; Joseph Eray, Glovelier; Rodolphe Cattin, La Chaux-de-Fonds, all of Switzerland

[73] Assignee: Compagnie de Montres Longines, Rue des Joncheres, Switzerland

[21] Appl. No.: 971,725

[22] Filed: Nov. 4, 1992

[30] Foreign Application Priority Data

Nov. 4, 1991 [CH] Switzerland ..... 3212910

[51] Int. Cl.[5] ..... G04B 37/00

[52] U.S. Cl. ..... 368/282; 368/281

[58] Field of Search ..... 368/280–289

[56] References Cited

U.S. PATENT DOCUMENTS

| | | | |
|---|---|---|---|
| 1,050,221 | 7/1913 | Matalene | 368/280 |
| 4,692,033 | 9/1987 | Mock et al. | 368/280 |
| 4,831,607 | 5/1989 | Muller | 368/309 |
| 5,065,374 | 11/1991 | Soder et al. | 368/280 |

FOREIGN PATENT DOCUMENTS

| | | |
|---|---|---|
| 0221233 | 5/1987 | European Pat. Off. . |
| 0269872 | 6/1988 | European Pat. Off. . |
| 0378125 | 7/1990 | European Pat. Off. . |
| 201996 | 12/1938 | Switzerland . |
| 355094 | 7/1961 | Switzerland . |
| 662698 | 10/1987 | Switzerland . |
| 675339 | 9/1990 | Switzerland . |

*Primary Examiner*—Bernard Roskoski

*Attorney, Agent, or Firm*—Weil, Gotshal & Manges

[57] ABSTRACT

The present invention concerns a watch case comprising a back cover (6) and two attachments (8, 9) for securing a bracelet, such back cover, together with the two attachments forming one and the same piece (4), each attachment (8, 9) comprising a base (30), a bridge (36) coupling said base (30) transversally to said back cover (6) and two horns (**34*b*, 34*d*) each located at one of the two ends of said base (30), this latter being located substantially in a general plane (40, 41) exhibiting an angular separation ($\alpha$) relative to the general plane (38) of said watch case, each of said horns exhibiting a general orientation axis (44, 45) substantially perpendicular to said general plane (40, 41**) of the said base to which it is attached.

12 Claims, 5 Drawing Sheets

WATCH CASE WITH SEPARABLE BACK COVER

The present invention concerns a watch case with back cover which is separable from the caseband. More specifically, this invention concerns a watch case provided with a back cover forming, together with the two bracelet attachments, one and the same piece.

BACKGROUND OF THE INVENTION

There is known from patent document CH 662 698 a watch case including a back cover separable from the caseband, such back cover forming, with the two bracelet attachments, one and the same piece. In this document the bracelet attachment comprises a base at the ends of which are located two horns serving for attaching the bar for securing the bracelet, the base of this attachment being connected to the back cover by a bridge. The bridge of such attachment takes the form of a rectangular parallelepipedon and the base of the attachment, of elongated form and oriented transversally to the bridge, exhibits an external surface located in the same plane as the external surface of said back cover of such watch case, the transversal cross-section of the base having the form of a triangle with a truncated external angle.

Each of the horns takes the form of a rectangular parallelepipedon located on one of the ends of the base of the attachment. Given that the cross-section of the base is of a truncated triangular form, the horn has a general orientation the direction of which is slightly angularly separated relative to the direction perpendicular to the plane defined by the external surface of the back cover of the watch case.

The attachment described in this document exhibits the following difficulty: the truncated triangular cross-section of the base associated with two horns each having the form of a rectangular parallelepipedon brings about manufacture in several stages necessitating at least one machining stage. This document thus describes a watch case exhibiting attachments with simple geometric forms but necessitating a relatively difficult putting into practice thereof.

A first purpose of the invention is to provide a watch case comprising a back cover separable from the caseband and forming, together with two attachments for securing a bracelet, one and the same piece, each attachment including two horns the general orientation of which exhibits an angular separation relative to the median plane three o'clock–nine o'clock of said watch case for a relatively modest manufacturing cost.

Another purpose of the invention is to provide such a watch case with horns having a form adapted to define a blind hole intended for the end of at least one securing means for said bracelet.

SUMMARY OF THE INVENTION

The present invention thus has as its objective a watch case comprising a caseband, a back cover defining a general plane and two attachments for securing a bracelet, such back cover together with the two attachments forming one and the same piece, each of said attachments, when projected into said general plane of said back cover, exhibiting substantially the general form of a T, the median branch of which forms a bridge for connecting the attachment to said back cover and the transversal branch of which forms a base for two horns extending respectively from the two ends of said base in one and the same direction according to a general orientation axis exhibiting an angular separation relative to the median plane three o'clock–nine o'clock of said watch case, the two horns belonging to a same attachment exhibiting substantially a plane of symmetry comprising said general orientation axis of each of such two horns, said watch case being characterized in that said base of each attachment is substantially symmetric relative to said plane of symmetry of the two horns extending from such base.

There results from these characteristics that it is easy to manufacture the piece forming the back cover and the two attachments for securing the bracelet solely by swaging and by bending, which permits manufacturing said piece in an industrial manner at relatively low cost. By swaging there is understood the process of upsetting and/or embossing various parts from a piece of metal.

In a preferred embodiment of the invention, said bridge coupling said base to said back cover is inwardly curved on the side of the external surface of such back cover, the profile formed by the external surfaces of said back cover, of said bridge and of said base in the median plane six o'clock–twelve o'clock of said watch case defining a continuous smooth line.

According to other characteristics of this preferred embodiment, said horns have a thickness greater than the thickness of the peripheral region of said back cover and each of such horns exhibits a blind hole having a single opening located in the internal surface of said horn and intended to accommodate an end of a means serving to secure said bracelet to said watch case.

According to a variant of such embodiment, said horns have substantially the form of half an ellipsoid of revolution.

There results from this preferred embodiment a watch case the thickness of which at the peripheral region of the back cover is independent of and substantially less than the thickness of the horns which exhibits a double advantage.

Initially, the thickness necessary for the horn in order that it may easily be provided with a blind hole intended to accommodate the end of a bracelet securing means and having an opening solely in the internal surface of such horn does not generate repercussions in respect of the thickness of the peripheral region of the back cover which enables this latter to be sufficiently small so as to give the watch case a minimum thickness without necessitating a hole which traverses the horn entirely for the end of the bar.

It will be noted that it is advantageous for forming the watch case, especially if the latter is water-tight, that the peripheral region of the back cover has a relatively small thickness in such a manner that such back cover, separable from the caseband, remains below the level of the hole for the time setting stem.

Secondly, the thickness of the horn being independent from the thickness of the peripheral region of the back cover, the horn may have a thickness sufficiently great so as to exhibit a harmonious form which underlines the aesthetic characteristic of such watch case, the horn having for example a form of a half-ellipsoid of revolution or a half-egg or any other artistic form evoking the artisanal work of a goldsmith.

Other characteristics and advantages of the invention will better appear upon reading the detailed description which follows made with reference to the attached drawings which are given solely by way of example.

DESCRIPTION OF THE PREFERRED EMBODIMENT

Figure 1:
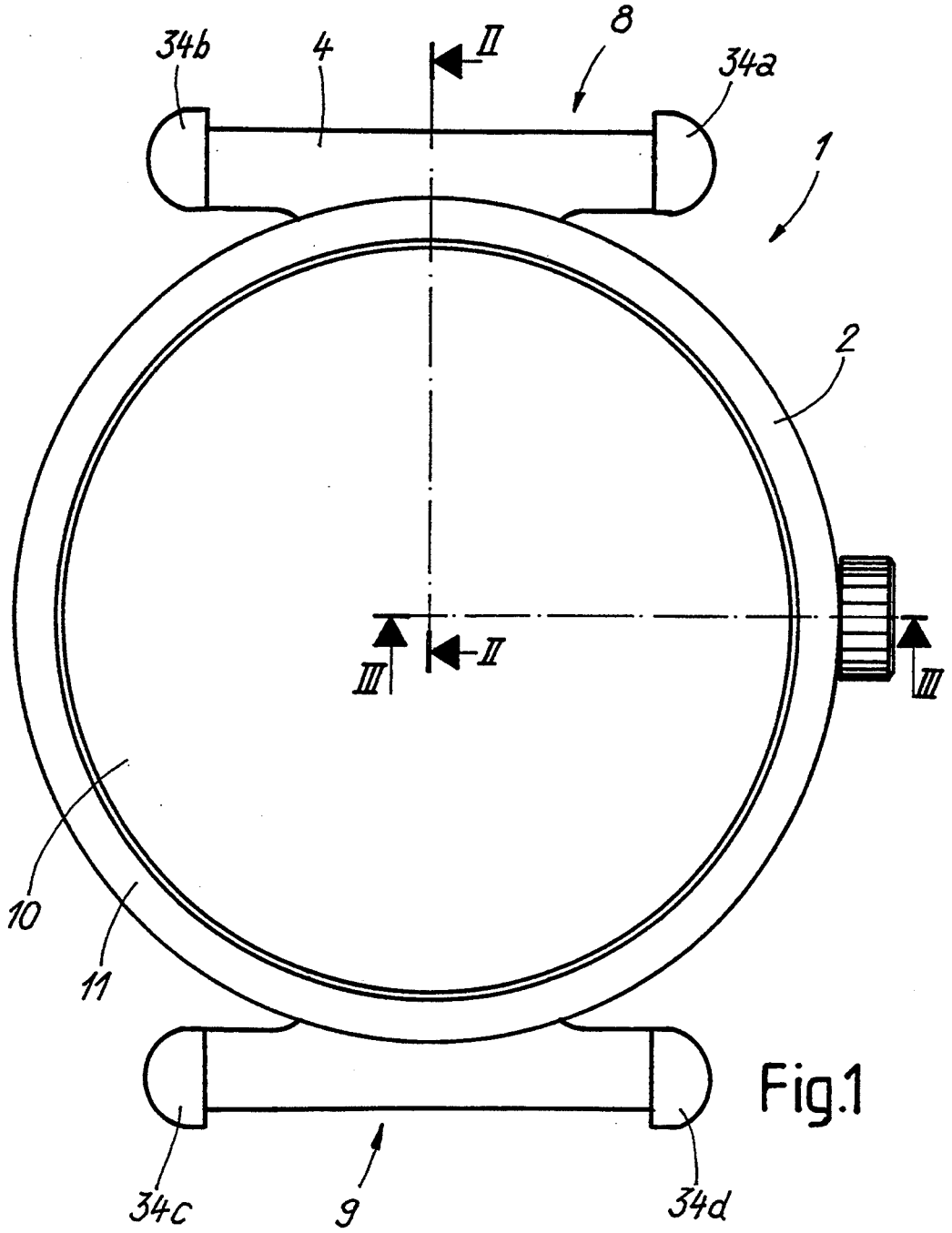
FIG. 1 shows a plan view of the watch case according to the invention.
Figure 2:
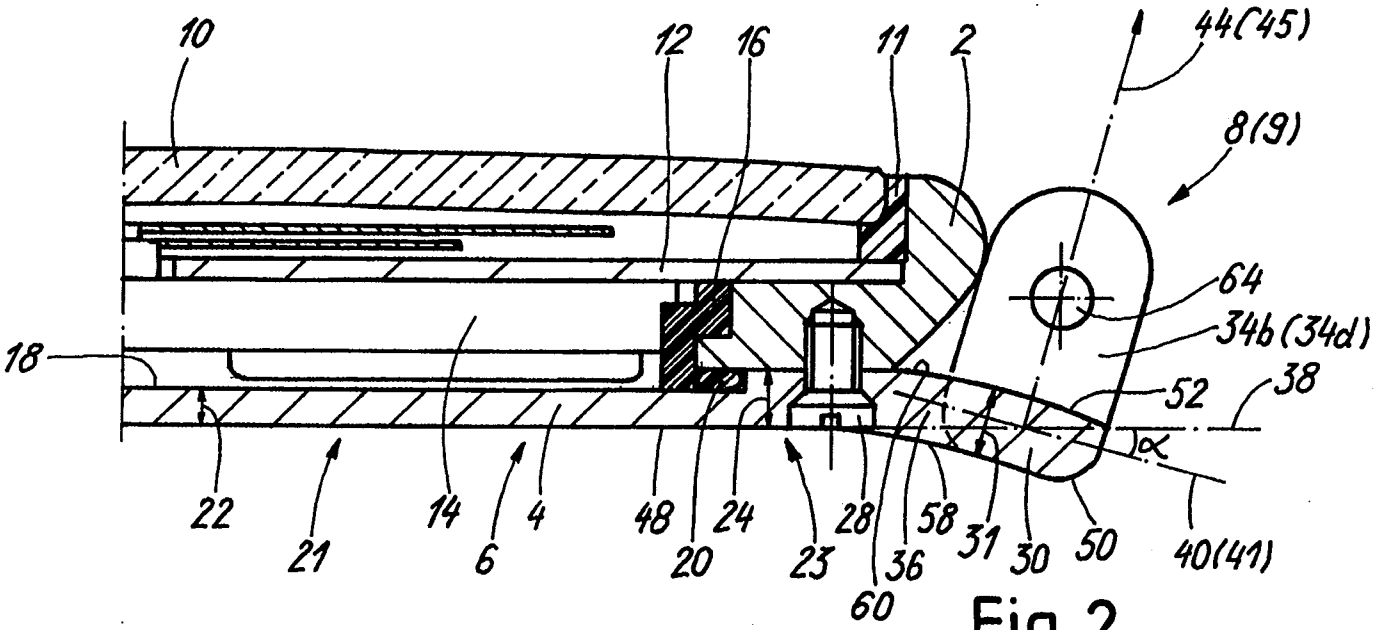
FIGS. 2 and 3 are respectively cross-sectional views along lines II—II and III—III of FIG. 1.
Figure 3:
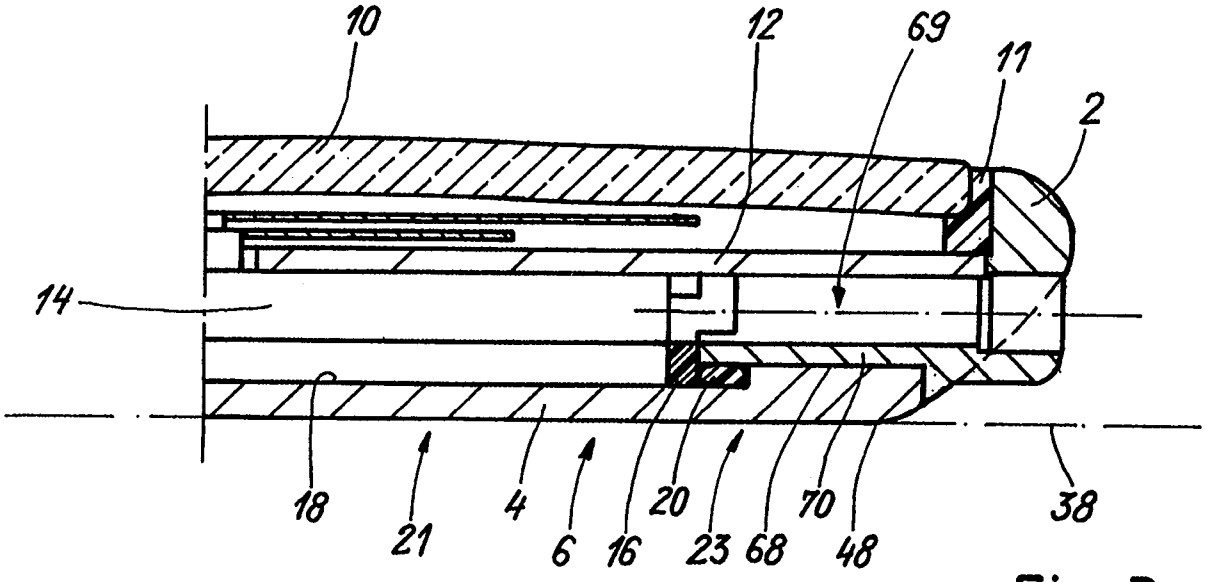
Figure 4:
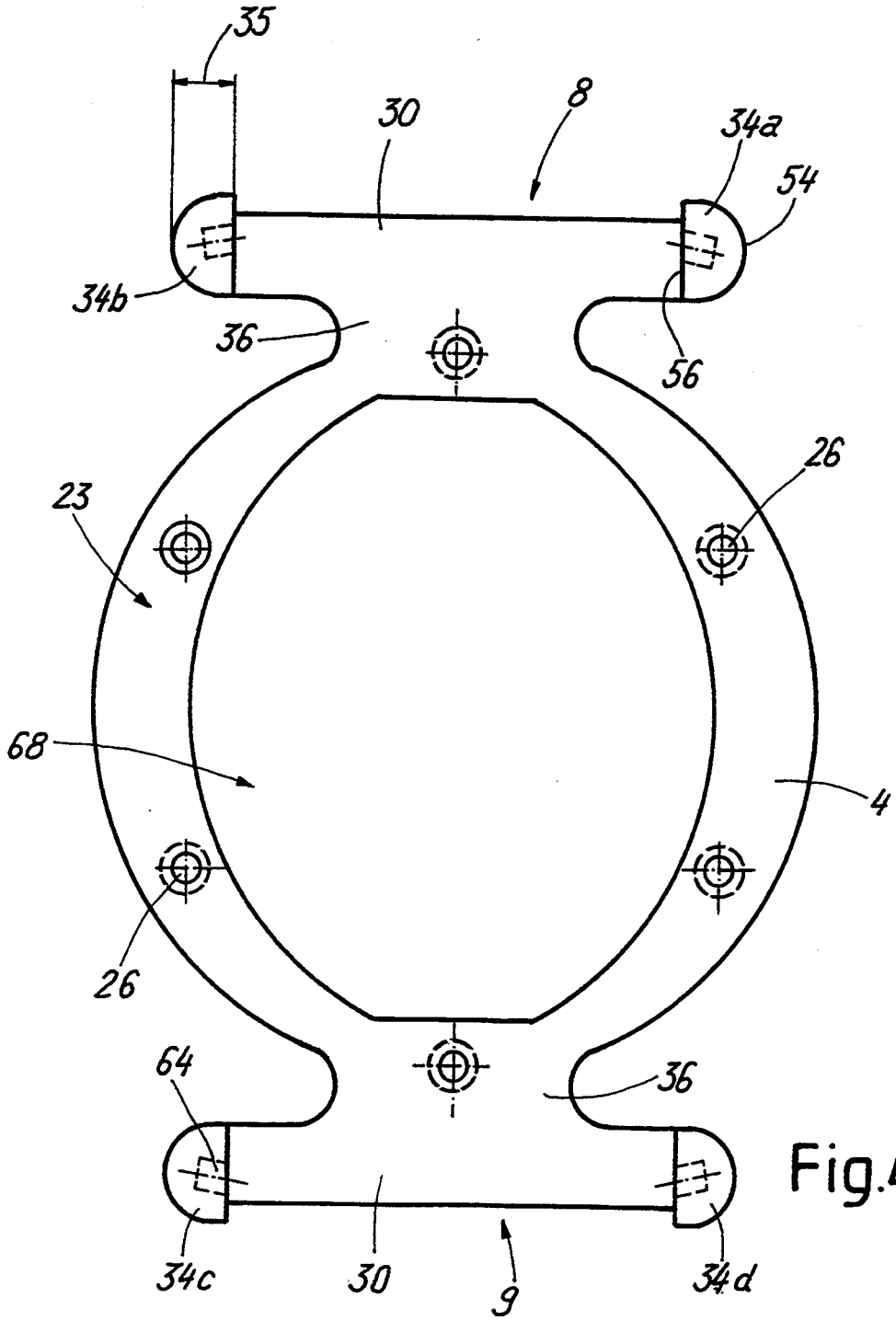
FIG. 4 is a plan view of the piece forming the back cover and the attachments for securing the bracelet of the watch case according to the invention.
Figure 5:
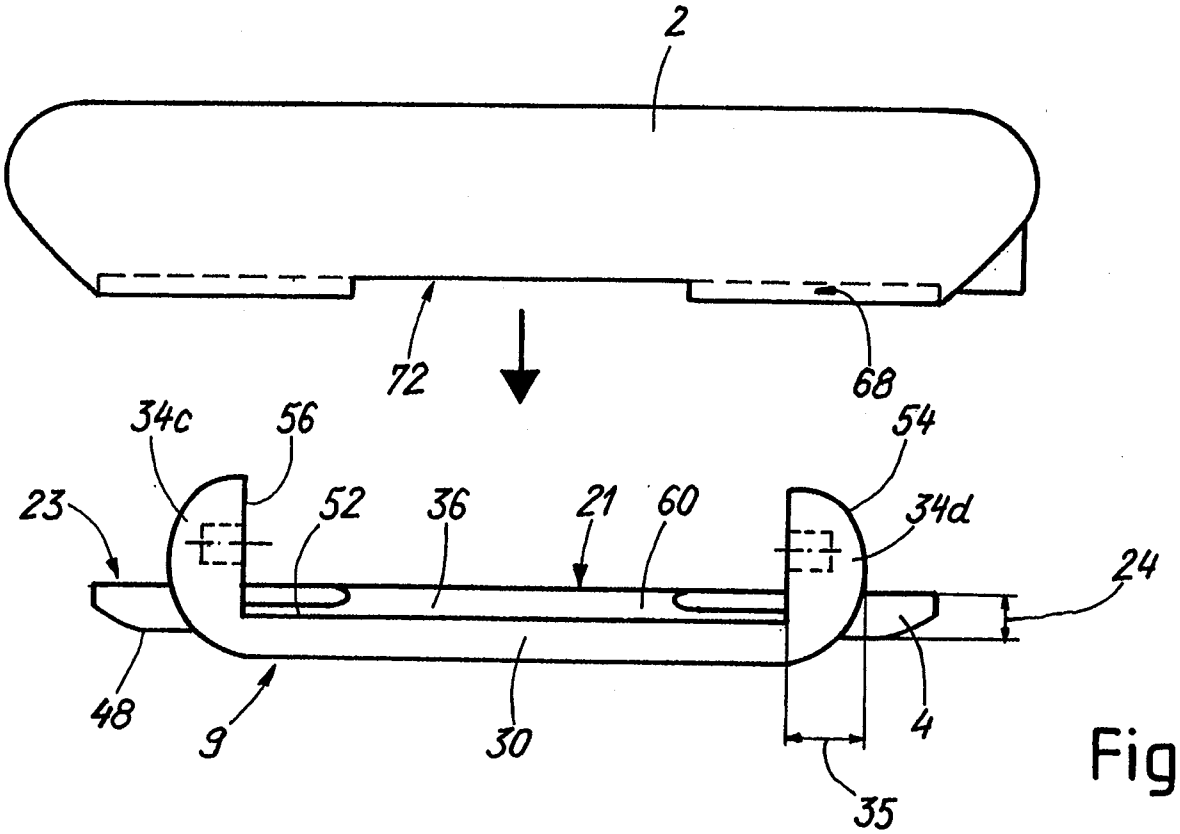
FIG. 5 is an exploded view of the watch case according to the invention when the latter is seen from the side according to a direction corresponding to the axis six o'clock–twelve o'clock of such watch case.

Referring now to FIGS. 1 to 5, there will be described hereinafter a preferred embodiment of a watch case according to the invention. The watch case 1 comprises a caseband-bezel 2 and a piece 4 forming the back cover 6 with the two attachments 8 and 9 serving to secure the bracelet. Such watch case further comprises a crystal 10 placed in a packing 11 which also operates as a flange between crystal 10 and the dial 12 of such watch.

Movement 14 of such watch is housed in a casing ring 16 having in radial cross-section an elongation which bears against the internal surface 18 of the back cover 6. A packing 20 is provided on the interior of a housing formed by the caseband-bezel 2, the back cover 6 and the casing ring 16.

Piece 4 forming the back cover with the two attachments serving to secure the bracelet primarily comprises four regions of distinct thickness. The thinnest region of a thickness 22 forms the central region 21 of the back cover 6. Such central region 21 comprising the region of superposition with movement 14 of the watch. The peripheral region 23 of the back cover forms a second region exhibiting a specific thickness 24, the outer edge of the back cover being rounded. The internal surface of such peripheral region 23 constitutes the contact surface with the caseband-bezel 2 of such watch case. Holes 26 are provided in this peripheral region 23, such holes being intended for the passage of securing screws 28 serving to hold together the caseband-bezel 2 and the piece 4 forming the back cover with the two attachments for securing the bracelet.

Next base 30 of each of the two attachments 8 and 9 forms a third region of piece 4 having a specific thickness, namely a thickness 31 slightly greater than the thickness 24 of the peripheral region 23 of such piece 4. Finally, such piece 4 further comprises four horns 34*a* to 34*d*, each of such horns defining a width 35 greater than thickness 24 of the peripheral region 23 of back cover 6 and greater than or equal to the thickness 31 of base 30 of attachment 8 or 9. It will be however noted that the thickness 31 of the base may be, in another variant of this embodiment, smaller than or equal to the thickness 24 of the peripheral region 23.

In addition to base 30 and horns 34*a* and 34*b*, respectively 34*c* and 34*d*, each of the two attachments 8 and 9 further comprises a bridge 36 connecting peripheral region 23 of the back cover 6 with base 30 of the attachments 8 and 9 respectively. Such bridge 36 exhibits a thickness diminishing progressively between thickness 24 of the peripheral region 23 and thickness 31 of base 30 of attachments 8 and 9 respectively. Such bridge 36 forms a necking down between back cover 6 and base 30 of the attachments 8 and 9 respectively. Thus, base 30 has the form of a bar transversally oriented to the direction defined by the two bridges 36 of piece 4 of such watch case. It will be noted that in the plan view of FIG. 4, each attachment exhibits the general form of a T.

In order to locate matters spacially in the watch case 1, there will be named "top" or "above" or again "upper portion of the watch" the region located at the side of crystal 10 of the watch, and "bottom", or "below" or again "lower portion of the watch case" the region defined by the back cover 6 of the watch case. The central region 21 of the back cover 6 of the watch case defines a general plane 38. This general plane 38 here is parallel to the general plane of the watch case. Base 30 of the attachments 8 or 9 respectively defines a general plane 40, 41 respectively. Such general plane 40, 41 respectively is angularly separated by an angle $\alpha$ relative to the general plane 38 of the back cover of the watch case. By general plane of a piece there will be understood the plane over which said piece extends in a substantial manner. Here it will be noted that the references between parentheses on FIG. 2 mention the elements which appear when the watch case of FIG. 1 is made to undergo a rotation of 180° of the reference plane of such FIG. 1.

The two horns 34*a* and 34*b* respectively 34*c* and 34*d* extending in one and the same sense from the two ends of base 30 of each of the two attachments 8 and 9 are oriented towards the top of the watch along a general orientation axis 44, 45 respectively substantially perpendicular to the general plane 40, 41 respectively of base 30 of the bracelet attachments 8 and 9 respectively. Thus, the horns of the two bracelet attachments 8 and 9 are oriented along a direction angularly separated by an angle $\alpha$ relative to the median plane three o'clock–nine o'clock of the watch case 1. The angular separation $\alpha$ of horns 34*a* to 34*d* enables separating such horns from the edge of the caseband-bezel 2 in giving them an orientation appropriate to the contour of the wrist of a person likely to wear such watch.

Furthermore, the two horns and the base of a common attachment show substantially a common plane of symmetry, such plane of symmetry comprising the two general orientation axes 44, 45 respectively of the two horns of such attachment.

Thanks to the structure of piece 4 forming the back cover 6 with the two attachments 8 and 9 and in particular from the last characteristic mentioned hereinabove, it is easily possible to manufacture such piece 4 by swaging and by bending. For example, there is obtained by swaging a piece with the horns oriented substantially in the elongation of the respective base. Then, by bending, such horns are oriented according to a direction substantially perpendicular to the general plane of the respective bases.

The bridge 36 connecting the peripheral region 23 of the back cover 6 to base 30 of the bracelet attachments 8 and 9 respectively is inwardly curved in a manner substantially continuous in direction from below the watch case, that is to say, from the side of the outer surface 48 of the back cover 6. The profile formed by the external surfaces 48, 58 and 50 of the back cover 6, of the bridge 36 and of the base 30 in the median plane six o'clock–twelve o'clock II—II defines a continuous smooth line. By smooth is meant that the line exhibits neither angle nor interruption. Thus, when the watch case 1 is placed on its back cover 6, piece 4 forming the back cover 6 with the two bracelet attachments 8 and 9 exhibits a convex profile in the region of the attachments 8 and 9.

It will be noted that in another embodiment of the invention, the two horns located at the ends of the base of each of the two attachments are oriented substantially towards the bottom of the watch case, the bridge connecting the peripheral region of the back cover to the base of the bracelet attachment being then curved inwardly in the direction of the top of the watch case, that is to say, at the side of the watch crystal. In this latter embodiment, the internal surface and the outer surface of the base of the bracelet attachment are inverted relative to the embodiment shown in FIGS. 1 to 5.

The base 30 of each of the two attachments 8 and 9 exhibits an external surface 50 and an internal surface 52 located at the side corresponding to the top of the watch case 1. Likewise, each of the horns 34*a* to 34*d* exhibits an external surface 54 and an internal surface 56. The bridge 36 of attachments 8, 9 respectively also possesses an external surface 58 and an internal surface 60 located at the side of the caseband-bezel 2. The internal surfaces 52 of base 30 and 56 of horns 34a and 34*b*, respectively 34*c* and 34*d* define a volume within which a bar may be placed for securing the bracelet (not shown), the ends of which are inserted within the cavities 64 provided in each of horns 34*a* to 34*d*. Such cavities 64 exhibit a single opening located in the internal surface 56 of the horns. They thus form blind holes and open towards the interior of the attachment.

It will be noted that the central region 21 of the back cover 6 of the watch case forms a recess in piece 4 comprising such back cover 6, the edges of such recess being defined by the peripheral region 23 of the back cover 6. On the other side, the back cover 6 is located partially within a recess 68 provided in the bottom of the caseband-bezel 2. It will be noted that such recess 68 remains below the lowest level of hole 69 provided for the time setting stem, thus leaving a material thickness belonging to the caseband-bezel 2 between the peripheral region 23 of the back cover and such hole 69. It will be further noted that in FIG. 3, the time setting stem and the crown have not been shown.

In order to give a monoshell aspect to the watch case while giving the caseband a form of flared cup which emphasizes the very flat characteristic of the watch, the diameter of back cover 6 is less than the diameter of crystal 10 of the watch case.

Given that bridge 36 connects the internal surface of the peripheral region 23 of back cover 6 with the internal surface 52 of base 30 in a continuous manner without interruption as well as the outer surface 48 of the back cover 6 with the outer surface 50 of base 30, a notch 72 is necessary on the lower edge of the caseband-bezel 2 defining recess 68.

Such notch 72 has a depth substantially corresponding to the depth of recess 68 formed in the bottom of the caseband-bezel 2.

In order to give the watch case harmonious forms and an elegant aspect, the outer surfaces of the peripheral region of the back cover 6, of the bridge 36 and of the base 30 are partially rounded off. Horns 34*a* to 34*d* show substantially the form of a half-ellipsoid of revolution, the plane surface defining the internal surface 56 while the convex surface defines the outer surface 54 of such horns. In a variant of this preferred embodiment of the invention, other forms may be provided, for example the form of half an egg. However, each of such forms must have a sufficient thickness in the region of cavity 64 serving to accommodate the end of the bracelet securing bar.

Finally, it will be noted that a watch case according to the invention may have a bezel formed by a part distinct from the part forming the caseband.

What is claimed is:

1. A watch case comprising a caseband, a back cover including a generally planar central region and two attachments integral with said central region for securing a bracelet to the watch case, each of said attachments comprising a base having two ends, two horns extending respectively from the two ends of said base in a first direction, said first direction having an angular separation relative to a first median plane containing the three o'clock–nine o'clock line of said watch case and perpendicular to the central region of said back cover, and a bridge for connecting said base to said back cover, said bridge being substantially perpendicular to a line joining the two ends of said base, the width of said bridge being less than the length of said base, said base including a generally planar portion extending between said two ends and being substantially perpendicular to the first direction in which the two horns extend from said base.

2. A watch case as set forth in claim 1 wherein said bridge connecting said base to said back cover is inwardly curved on the side of the outer surface of said back cover, the profile formed by the external surfaces of said back cover, said bridge and said base in a second median plane which contains the six o'clock–twelve o'clock line of said watch case and is perpendicular to the three o'clock–nine o'clock line of said watch case defining a continuous smooth line.

3. A watch case as set forth in claim 1 wherein said horns are of a thickness greater than the thickness of the peripheral region of said back cover, each of said horns having a blind hole the sole opening of which is located in the internal surface of said horn for receiving one end of means serving to secure said bracelet to said watch case.

4. A watch case as set forth in claim 1 wherein each of said horns has substantially the form of half of an egg.

5. A watch case as set forth in claim 1 wherein said one and the same piece forming said back cover with its two attachments is obtained by swaging and bending.

6. A watch case as set forth in claim 1 including a first recess defining the central region of said back cover in said piece forming the back cover with its two attachments, such first recess being intended for the partial accommodation of a timepiece movement.

7. A watch case as set forth in claim 1 wherein said piece forming the back cover with its two attachments comprises holes in the peripheral region of said back cover, said watch case including screws serving to secure said piece to said caseband of said watch case.

8. A watch case as set forth in claim 1 further including a second recess provided in the bottom of the caseband of said watch case wherein said back cover is located partially within said second recess.

9. A watch case as set forth in claim 8 further including a hole provided in said caseband for a time setting stem and wherein the top of the peripheral region of said back cover is below the lowest level of said hole.

10. A watch case as set forth in claim 8 further including two notches on the edge of said bottom of the caseband said two notches defining said second recess in order to enable passage of said bridge for each of the two attachments.

11. A watch case as set forth in claim 1 wherein the diameter of said back cover is less than the diameter of the crystal for said watch case, the caseband of such watch case having the form of a flared cup.

12. A watch case as set forth in claim 9 further including two notches on the edge of said bottom of the caseband said two notches defining said second recess in order to enable passage of said bridge for each of the two attachments.

* * * * *